US006817299B1

(12) United States Patent
Cooke

(10) Patent No.: US 6,817,299 B1
(45) Date of Patent: Nov. 16, 2004

(54) FRAGMENTING PROJECTILE HAVING THREADED MULTI-WALL CASING

(75) Inventor: David P. Cooke, Richmond, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/732,146

(22) Filed: Dec. 10, 2003

(51) Int. Cl.[7] ..... F42B 12/32
(52) U.S. Cl. ..... 102/493; 102/506
(58) Field of Search ..... 102/493–497, 102/506

(56) References Cited

U.S. PATENT DOCUMENTS

| | | | | | |
|---|---|---|---|---|---|
| 2,007,026 | A | * | 7/1935 | Robertson | 102/493 |
| 3,000,309 | A | | 9/1961 | Zapf | 102/67 |
| 3,677,181 | A | * | 7/1972 | Gijarhus et al. | 102/364 |
| 3,718,091 | A | * | 2/1973 | Theate | 102/496 |
| 3,820,464 | A | | 6/1974 | Dixon | 102/67 |
| 4,089,267 | A | | 5/1978 | Mescall et al. | 102/67 |
| 4,167,140 | A | * | 9/1979 | Biserod | 102/364 |
| 4,237,787 | A | * | 12/1980 | Wacula et al. | 102/364 |
| 4,365,560 | A | * | 12/1982 | Frostig | 102/493 |
| 4,515,083 | A | | 5/1985 | Caruso | 102/493 |
| H238 | H | | 3/1987 | Adams | 102/493 |
| 4,665,827 | A | | 5/1987 | Ellis, II | 102/510 |
| 4,671,181 | A | * | 6/1987 | Romer et al. | 102/364 |
| 4,854,242 | A | * | 8/1989 | Katzmann | 102/506 |
| 4,986,188 | A | | 1/1991 | Denis et al. | 102/493 |
| 5,117,759 | A | | 6/1992 | Henderson et al. | 102/496 |
| 5,131,329 | A | | 7/1992 | Lips et al. | 102/364 |
| 5,175,392 | A | * | 12/1992 | Denis | 102/364 |
| 5,445,079 | A | * | 8/1995 | Boual | 102/506 |
| 5,569,874 | A | | 10/1996 | Nelson | 102/507 |
| 5,894,645 | A | | 4/1999 | Hallis et al. | 29/1.23 |
| 6,119,600 | A | * | 9/2000 | Burri | 102/364 |
| 6,598,536 | B2 | * | 7/2003 | Burri | 102/506 |

FOREIGN PATENT DOCUMENTS

| | | | | |
|---|---|---|---|---|
| GB | 1142716 | * | 2/1969 | 102/493 |

* cited by examiner

*Primary Examiner*—Harvey E. Behrend
(74) *Attorney, Agent, or Firm*—Matthew J. Bussan, Esq.; Marguerite O. Dineen, Esq.; Scott R. Boalick, Esq.

(57) ABSTRACT

A fragmenting projectile includes a multi-wall projectile casing with each wall thereof formed by a sleeve. Each pair of adjacent sleeves is defined by inner and outer sleeves that mate in a threaded engagement. Explosive material is disposed in an innermost sleeve.

8 Claims, 2 Drawing Sheets

FRAGMENTING PROJECTILE HAVING THREADED MULTI-WALL CASING

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to fragmenting projectiles, and more particularly to a fragmenting projectile having casings that are threadably engaged to one another.

BACKGROUND OF THE INVENTION

Naturally fragmenting warheads are primarily implemented in gun projectiles, mortar rounds and small rockets. These warheads are generally a compromise between cost and warhead case fragmentation performance. Although naturally fragmenting warheads are generally the least expensive method of high-volume warhead production, they usually do not fragment into the optimum fragment size for their given application or target set. For example, the target set for most gun-fired projectiles and mortar rounds includes personnel and other "light" targets such as trucks. Such applications generally require an optimum fragment size of approximately 15–30 grains. This fragment size is difficult to consistently achieve with naturally fragmenting warheads. Specifically, fragments are often too large which results in inefficient warhead performance.

In an effort to control warhead fragmentation, a variety of approaches are currently used. For example, warhead cases have been scored in accordance with a predetermined pattern. However, warhead case scoring has not created the necessary small size fragments without sacrificing structural requirements of the warhead. Another approach provides a pre-formed fragmentation warhead design (e.g., implementing cubes or spheres in a composite material shell). However, the cost of this type of design is relatively high and is generally only applicable to low production volume warheads (e.g., missile warheads). Still another approach is the dual-wall naturally fragmenting (and combination natural fragmenting and scored wall) warhead. While these types of warheads have provided somewhat of an improvement over single-wall naturally fragmenting warheads, current dual-wall designs generally require thermal conditioning (i.e., both hot and cold temperature treatment) manufacturing methods to mate walls together with tight circumferential tolerances. However, the thermal conditioning processing steps are time consuming and expensive to implement. Further, the precision of these steps is difficult to maintain over large production runs.

SUMMARY OF THE INVENTION

Accordingly, it is an object of the present: invention to provide a fragmenting projectile.

Another object of the present invention is to provide a fragmenting projectile that produces consistently-sized fragments while providing structural integrity, that can withstand firing loads.

Still another object of the present invention is to provide a fragmenting projectile that is easy to manufacture.

Other objects and advantages of the present invention will become more obvious hereinafter in the specification and drawings.

In accordance with the present invention, a fragmenting projectile utilizes a multi-wall projectile casing with each wall thereof formed by a sleeve. Each pair of adjacent sleeves is defined by an inner sleeve and an outer sleeve that mate in a threaded engagement. Explosive material is disposed in an innermost sleeve of the multi-wall projectile casing.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
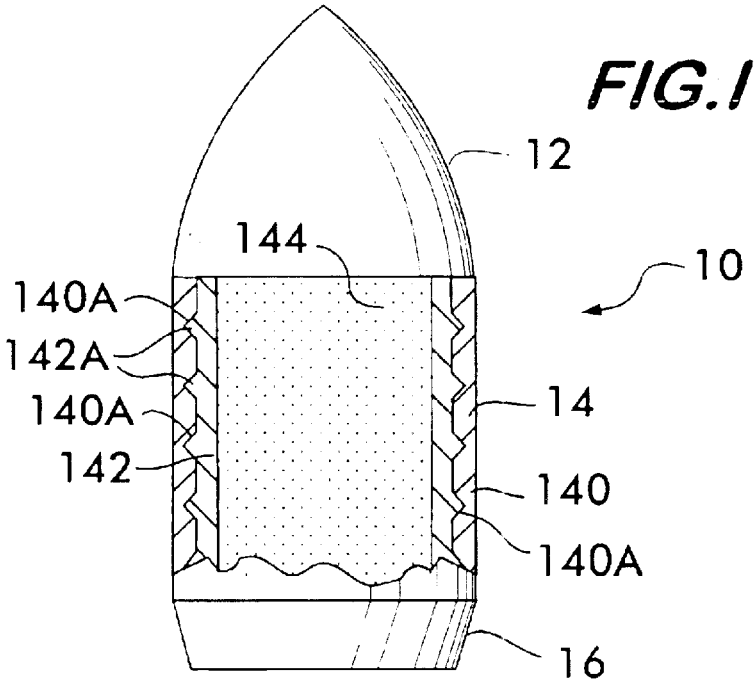
FIG. 1 is a partial sectional view of a portion of a fragmenting projectile having a threaded multi-wall casing in accordance with the present invention.

Referring now to the drawings, and more particularly to FIG. 1, an embodiment of a fragmentation projectile in accordance with the present invention is shown and is referenced generally by numeral 10. Projectile 10 typically has a nose section 12, a main body section 14, and a tail section 16. It is to be understood that the shape, size and contents of each of nose section 12 and tail section 16 can be tailored to meet a specific application and are not limitations of the present invention. Furthermore, the coupling of each of nose section 12 and tail section 16 to main body section 14 can utilize a variety of established methods/structures without departing from the scope of the present invention.

Main body section 14 illustrates an embodiment of a multi-wall casing which, as illustrated, is defined by an outer casing sleeve 140 and an inner casing sleeve 142 with an explosive material 144 disposed within inner sleeve 142. Material choices for sleeves 140 and 142, and for, explosive material 144, are well known in the art and are not considered limitations of the present invention. The mechanism (not shown) used to detonate explosive material 144 is also a design choice that is not a limitation of the present invention.

Each of sleeves 140 and 142 is a cylindrical sleeve. Sleeves 140 and 142 are threadably joined to one another all along (as shown) or partially along the length thereof. Note that if sleeves 140 and 142 are threadably mated only partially along the length thereof, the remaining interface between the two sleeves will typically be defined by a close-tolerance fit.

Figure 2:
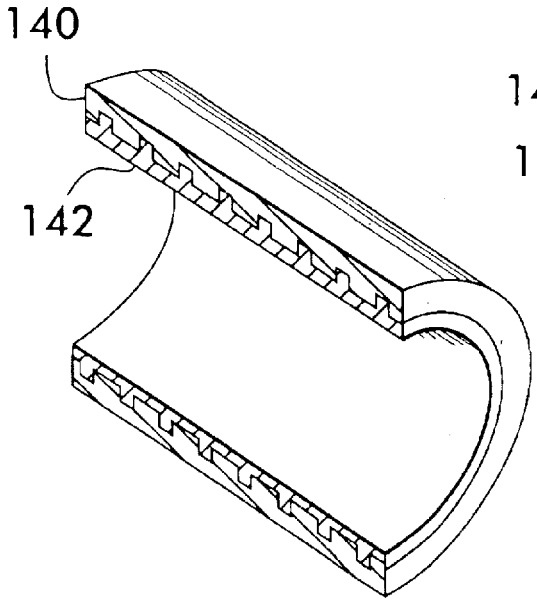
FIG. 2 is an isolated sectional perspective view of another threaded multi-wall casing using a square type of threaded engagement.
Figure 3:
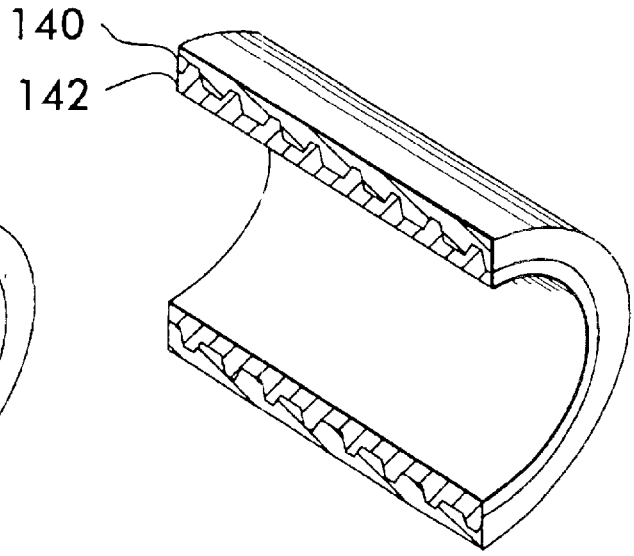
FIG. 3 is an isolated sectional perspective view of another threaded multi-wall casing using a stub type of threaded engagement.
Figure 4:
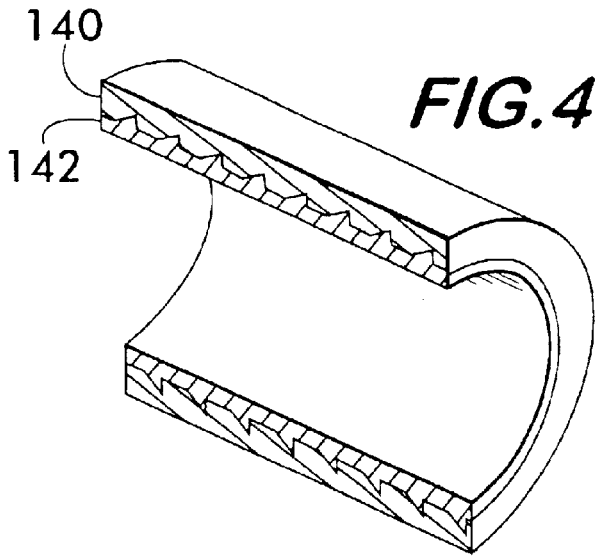
FIG. 4 is an isolated sectional perspective view of another threaded multi-wall casing using a buttress type of threaded engagement.

In general, inner sleeve 142 can be threaded-into outer sleeve 140 using any thread type such as any standard type (e.g., see FIG. 1), square type (FIG. 2), stub type (FIG. 3), or buttress type (FIG. 4), just to name a few. Furthermore, the thread type could be defined by a custom design not conforming to existing standards. Thus, the thread type used to mate sleeves 140 and 142 is not a limitation of the present invention. Furthermore, the pitch of the threads on sleeves 140 and 142 can be varied to tailor fragmentation for specific fragment sizes without departing from the scope of the present invention. The threading of sleeves 140 and 142 simplifies the manufacturing of main body section 14 while also ensuring a tight fit therebetween.

As mentioned above, any type of threaded engagement between inner sleeve 142 and outer sleeve 140 can be used. However, it is preferred that the outer surface of inner sleeve 142 be manufactured as the "male threaded" part and that the inner surface of outer sleeve 140 be manufactured as the "female threaded" part. Case fragmentation control is thereby obtained by varying the profile (i.e., the thread type), depth and pitch of the threads on both the: inner and outer sleeves.

Figure 6:
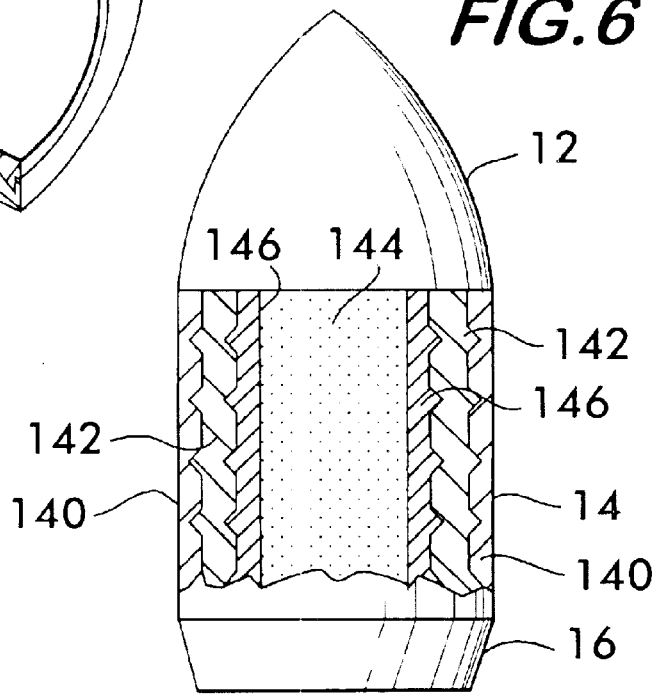
FIG. 6 is a partial sectional view of a portion of a fragmenting projectile according to another embodiment of the present invention in which the multi-wall casing is made from three threadably engaged sleeves.
Figure 5:
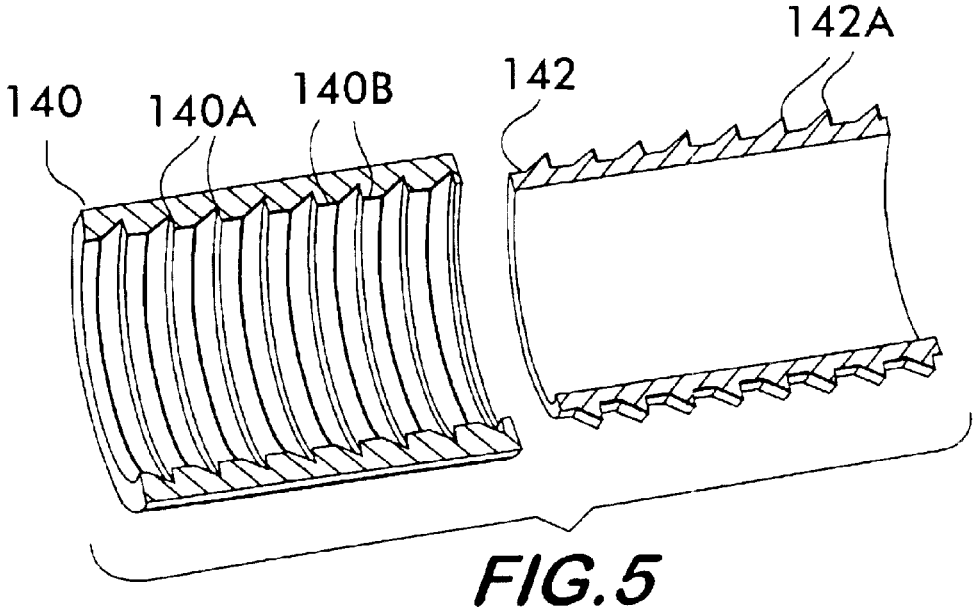
FIG. 5 is an isolated sectional perspective view of the two sleeve casing shown in FIG. 1 prior to threaded assembly thereof.

Although the present has been described for a two-sleeve casing, the present invention is not so limited as three or more sleeves could be threaded together to define the casing for an explosive material. For example, a three-sleeve casing is illustrated in FIG. 6 where a: third or innermost sleeve 146 is threadably received into inner sleeve 142. Since sleeve 146 is inside of sleeve 142, it is preferred that the outer surface of sleeve 146 defines a male threaded part while the inner surface of sleeve 142 defines a female threaded part.

The advantages of the present invention are numerous. Manufacturing of a multi-wall fragmenting projectile casing is simplified as only threaded engagement of adjacent casing sleeves is required during the assembly process. The threaded engagement provides the necessary projectile casing structural integrity required for high-load launch environments and projectile penetrations, while also providing controlled projectile fragmentation upon projectile detonation.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A fragmenting projectile body adapted to have a nose and tail coupled thereto at either end thereof to define a projectile, said projectile body comprising:

an outer sleeve;

an inner sleeve threadably engaged to said outer sleeve all along the lengths thereof, said inner sleeve and said outer sleeve being threadably engaged to one another by complementary threads having a thread type, depth and pitch;

explosive material disposed in said inner sleeve; and said inner sleeve threadably engaged to said outer sleeve defining a structural unit that (i) remains intact during a launch of the projectile and during penetration of a target by the projectile, and (ii) fragments when said explosive material is detonated in a manner controlled by said thread type, depth and pitch of said complementary threads.

2. A fragmenting projectile body as in claim 1 wherein said inner sleeve is formed as a male threaded part and said outer sleeve is formed as a female threaded part.

3. A fragmenting projectile body as in claim 1 wherein said thread type is selected from the group consisting of standard, buttress, square, and stub thread types.

4. A fragmenting projectile body as in claim 2 wherein said thread type is selected from the group consisting of standard, buttress, square, and stub thread types.

5. A fragmenting projectile body adapted to have a nose and tail coupled thereto at either end thereof to define a projectile, said projectile body comprising:

a multi-wall projectile casing defined by a plurality of sleeves with adjacent ones of said plurality of a sleeves being defined by an inner sleeve and an outer sleeve threadably engaged to one another all along the lengths thereof, said inner sleeve and said outer sleeve being threadably engaged to one another by complementary threads having a thread type, depth and pitch;

said plurality of sleeves having an innermost sleeve defining a cavity all along the length thereof;

explosive material disposed in said cavity of said innermost sleeve; and said multi-wall projectile casing defining a structural unit that (i) remains intact during a launch of the projectile and during penetration of a target by the projectile, and (ii) fragments when said explosive material is detonated in a manner controlled by said thread type, depth and pitch of said complementary threads.

6. A fragmenting projectile body as in claim 5 wherein, for each of said adjacent ones of said plurality of sleeves, said inner sleeve is formed as a male threaded part and said outer sleeve is formed as a female threaded part.

7. A fragmenting projectile body as in claim 5 wherein, for each of said adjacent ones of said plurality of sleeves, said thread type is selected from the group consisting of standard, buttress, square, and stub thread types.

8. A fragmenting projectile body as in claim 6, for each of said adjacent ones of said plurality of sleeves, said thread type is selected from the group consisting of standard, buttress, square, and stub thread types.

* * * * *